United States Patent [19]

Novoselac

[11] 4,347,971

[45] Sep. 7, 1982

[54] CENTRIFUGE APPARATUS

[75] Inventor: John Novoselac, Ontario, Canada

[73] Assignee: Joy Manufacturing Company, Pittsburgh, Pa.

[21] Appl. No.: 238,498

[22] Filed: Feb. 26, 1981

Related U.S. Application Data

[60] Division of Ser. No. 959,817, Nov. 9, 1978, abandoned, which is a continuation-in-part of Ser. No. 773,991, Mar. 3, 1977, abandoned.

[51] Int. Cl.[3] ..... B04B 11/00

[52] U.S. Cl. ..... 233/20 R; 233/27

[58] Field of Search ..... 233/3, 12, 16, 21, 22, 233/19 R, 19 A, 27, 28, 45, 40, 38, 34, 20 R

[56] References Cited

U.S. PATENT DOCUMENTS

| | | | |
|---|---|---|---|
| 1,100,872 | 6/1914 | Hall . | |
| 1,101,548 | 6/1914 | Hoffman . | |
| 1,328,084 | 1/1920 | Hackett . | |
| 1,585,393 | 5/1926 | Laughlin . | |
| 1,613,579 | 1/1927 | Hinchley et al. | |
| 2,087,727 | 7/1937 | Bath | 233/20 |
| 2,126,864 | 8/1938 | Bath | 233/20 |
| 2,178,547 | 11/1939 | Bjornstjerna | 233/20 |
| 2,378,778 | 6/1945 | Lindgren et al. | 233/20 |
| 2,394,015 | 2/1946 | Schutte et al. | 233/27 |
| 2,578,456 | 12/1951 | Smith | 233/7 |
| 2,616,620 | 11/1952 | Zimmerman | 233/19 R |
| 2,733,856 | 2/1956 | Kjellgren | 233/7 |
| 2,750,040 | 6/1956 | Strich | 210/73 |
| 2,821,340 | 1/1958 | Van Wijngaarden | 233/46 |
| 2,878,995 | 3/1959 | Dega | 233/27 |
| 3,081,027 | 3/1963 | Coulson | 233/4 |
| 3,085,742 | 4/1963 | Palmqvist | 233/15 |
| 3,087,645 | 4/1963 | Eddy et al. | 220/63 |
| 3,119,775 | 1/1964 | Wilsmann et al. | 233/4 |
| 3,179,334 | 4/1965 | Sharples | 233/20 |
| 3,233,535 | 2/1966 | Fowlie | 99/289 |
| 3,273,790 | 9/1966 | Dahlberg | 233/18 |
| 3,281,068 | 10/1966 | Baram | 233/20 |
| 3,297,243 | 1/1967 | Hein | 233/26 |
| 3,297,244 | 1/1967 | Hein | 233/27 |
| 3,322,336 | 5/1967 | Lohse | 233/21 |
| 3,347,456 | 10/1967 | Kobbernagel | 233/20 |
| 3,393,863 | 7/1968 | Baram | 233/20 |
| 3,408,001 | 10/1968 | Nilsson | 233/20 |
| 3,410,481 | 11/1968 | Dahlberg et al. | 233/29 |
| 3,494,544 | 2/1970 | Thylefors | 233/19 |
| 3,532,265 | 10/1970 | Baram | 233/20 |
| 3,535,158 | 10/1970 | McBride et al. | 127/24 |
| 3,582,934 | 6/1971 | Zumhulsen . | |
| 3,593,915 | 7/1971 | Steinacker | 233/20 |
| 3,599,861 | 8/1971 | DeMartini . | |
| 3,623,657 | 11/1971 | Trump . | |
| 3,666,170 | 5/1972 | Cacciabue et al. | |
| 3,750,940 | 8/1973 | Nilsson | 233/19 A |
| 3,774,840 | 11/1973 | Boatright . | |
| 3,777,972 | 12/1973 | Kjellgren . | |
| 3,799,431 | 3/1974 | Lavanchy et al. | |
| 3,823,868 | 7/1974 | Baram | 233/20 A |
| 3,823,869 | 7/1974 | Loison . | |
| 3,825,177 | 7/1974 | Kohlstette | 233/20 A |
| 3,854,657 | 12/1974 | Pause et al. | |
| 3,863,838 | 2/1975 | Pronk. | |
| 3,875,753 | 3/1975 | Niemeyer. | |
| 3,884,806 | 5/1975 | Coughlin et al. | |
| 3,930,608 | 1/1975 | Baram. | |
| 3,948,771 | 4/1976 | Bielefeldt. | |
| 3,948,780 | 4/1976 | Ilin et al. | 210/380 R |
| 3,955,758 | 5/1976 | Loison. | |
| 3,956,131 | 5/1976 | Harvey. | |
| 3,971,509 | 7/1976 | Johnsen . | |
| 3,971,510 | 7/1976 | Morse . | |
| 4,001,121 | 1/1977 | Bielefeldt . | |
| 4,206,871 | 6/1980 | Nilsson . | |

FOREIGN PATENT DOCUMENTS

| | | |
|---|---|---|
| 829940 | 3/1960 | United Kingdom . |
| 1005117 | 9/1965 | United Kingdom . |
| 1199880 | 7/1970 | United Kingdom . |
| 1442379 | 7/1976 | United Kingdom . |

*Primary Examiner*—Robert W. Jenkins

*Attorney, Agent, or Firm*—William J. O'Rourke, Jr.

[57] ABSTRACT

A centrifuge is disclosed comprising an elongated shaft, rotatable about its longitudinal central axis, a bowl having upper and lower portions secured to axially spaced portions of the shaft forming a centrifuge chamber therein. The shaft has a passageway for receiving a slurry and for discharging the slurry into an axially lower portion of a passageway in the lower portion of the bowl, which passageway includes a portion which imparts a rotational velocity to the slurry flowing therethrough.

10 Claims, 12 Drawing Figures

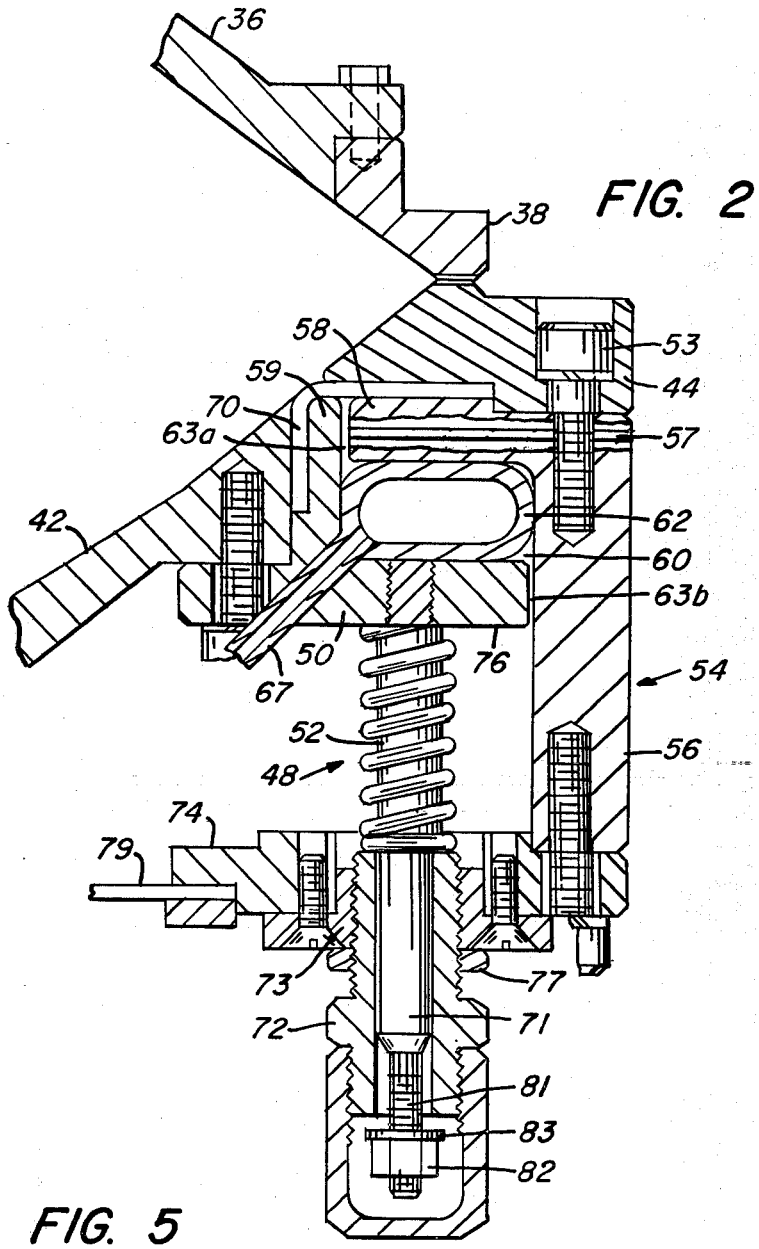
FIG. 2
FIG. 5
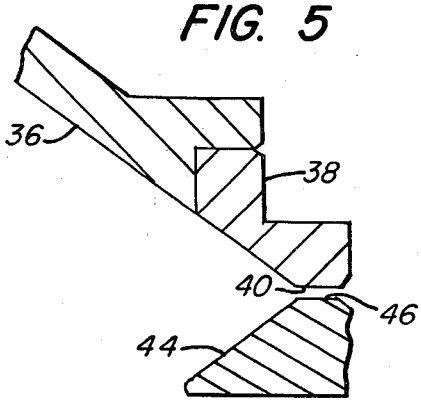

CENTRIFUGE APPARATUS

This application is a division, of application Ser. No. 959,817, filed Nov. 9, 1978, now abandoned, which is a continuation-in-part of U.S. application Ser. No. 773,991 filed Mar. 3, 1977 (now abandoned).

Centrifugal separators or centrifuges for numerous applications such as for separating fluid mixtures into relatively higher density and lower density fractions are well known in the art. The hydraulic transporting of mill tailings to provide a mine backfill material is one well known example of such prior applications. Regardless of the application, prior centrifuges have required that the incoming material or slurries be accelerated and distributed prior to the material being subjected to centrifugal separation. In view of the numerous structures of prior centrifuges it is impractical to comment upon all known structures for distributing and accelerating slurries; however, many of such structures have various disadvantages as compared to the structure of this invention. Thus, many prior centrifuges have distributor accelerators which have high fabrication cost, high pressure discharge, high operational energy requirements and/or create undesirable turbulence in the separating bowl. In particular, the distributor-accelerator of many prior centrifuges have been dependent upon the back pressure generated within the separating bowl to provide the necessary back pressure on the incoming slurry which dependency creates an undesired turbulence and lowers the separating efficiency of the centrifuge.

Similarly various prior mechanisms for controlling the discharge of material from the separating bowl of a centrifuge have one or more of various above stated disadvantages Further, some prior discharge control mechanisms have utilized differences in hydrostatic pressures within the centrifuge which make such mechanisms undesirably dependent upon the rotational velocity of the centrifuge and the densities of the materials having the utilized hydrostatic pressures. Other control mechanisms have utilized flexible membranes which require proper installation and are subject to rupture. The various prior control mechanisms have been subject to various disadvantages such as tilting, abrasion, complex components and the like such that a complete enumeration of all such disadvantages is impractical.

The centrifuge of this invention overcomes various disadvantages of prior centrifuges, such as those enumerated above, by having the supply of slurry and the discharge of material governed by factors basically independent of the variable physical conditions existing within the separator bowl.

Accordingly, one object of this invention is to provide new and improved apparatus for controlling the supply of slurry to and the discharge of material from a separating bowl of a centrifuge.

Another object of this invention is to provide a new and improved apparatus for introducing an incoming slurry to a separating bowl of a centrifuge at a pressure which is selected with reference to but is not determined by the pressure existing within the separating bowl.

A more specific object of this invention is to provide a new and improved apparatus for introducing an incoming slurry to a separating bowl of a centrifuge at substantially the same angular velocity as the angular velocity of the material within the separating bowl.

Still another more specific object of this invention is to provide a new and improved apparatus for introducing an incoming slurry to a separating bowl of a centrifuge at a velocity and in a direction to minimize any turbulence with reference to the material within the separating bowl.

Another object of this invention is to provide a new and improved apparatus for controlling the discharge of material from a centrifuge which is operable independently of the physical properties of the material within the centrifuge.

Another object of this invention is to provide a new and improved apparatus for controlling the discharge of material from a centrifuge which is readily removable from the structure of the centrifuge.

A more specific object of this invention is to provide a new and improved apparatus for controlling the discharge of material from a centrifuge which is actuated by an annular flexible tube which is constrained about its entire periphery and is selectively pressurized.

These and other objects of this invention will be better understood upon consideration of the following detailed description of presently preferred embodiments thereof taken in conjunction with the following drawings, wherein:

FIG. 2 is an enlarged cross sectional view with portions thereof in side elevation of a material discharge control mechanism as shown in FIG. 1;

FIG. 5 is an enlarged view in the open position of the structure forming the discharge opening of the apparatus as shown in FIG. 1.

Figure 1:
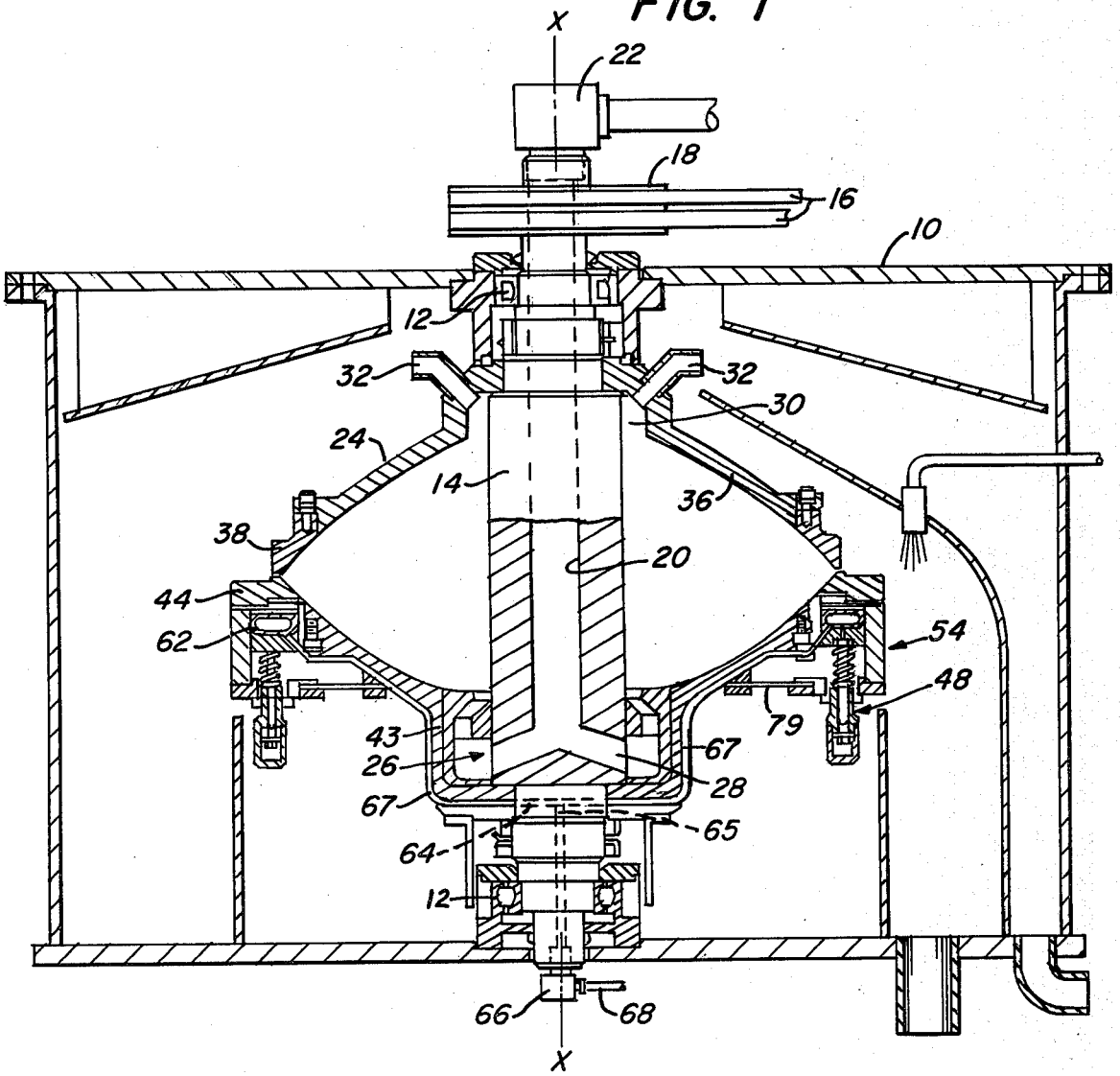
FIG. 1 is a cross sectional view with portions thereof in side elevation of a centrifuge apparatus constructed in accordance with the principles of this invention.

Centrifuges of the rotary bowl type are well known in the art. The rotary bowl centrifuge shown in FIG. 1 comprises a stationary formed housing 10 having vertically spaced and aligned bearings 12 for supporting an elongated shaft 14 for rotation about is vertical rotation axis X—X. In the description herein the term radial and circumferential is with reference to the rotation axis X—X, the term axial is with reference to the rotation axis X—X or any axis parallel thereto, and the terms upper and lower and the like are used for convenience in this description with respect to the showing of the figures herein. Shaft 14 is suitably rotationally driven by means of a controllable motor (not shown) having drive belts 16 cooperable with a pulley 18 rigidly secured to the shaft 14 upwardly adjacent the housing 10. Shaft 14 is provided with a central vertically extending passageway 20 therein with the upper end being open and cooperable with a feed pipe assembly 22 to supply the material, i.e. the slurry, to be separated in the centrifuge. A separation chamber or bowl 24, comprising formed upper and lower members, is suitably rigidly secured to shaft 14 to rotate therewith within housing 10. The lowermost portion of the bowl 24 has a distributor-accelerator member 26 which member 26 has an interior passageway in open communication with ports 28 extending laterally and downwardly from the inner end of passageway 20. Bowl 24 has an uppermost central annular chamber 30 encompassing the upper portion of the shaft 14 with circumferentially spaced discharge ports 32 extending upwardly and outwardly of the chamber 30 and in open fluid communication therewith. Material is discharged from the bowl 24 through ports 32 with the flow thereof being suitably directed within housing 10 by suitable means.

In operation the mixture to be subjected to centrifugal action of the centrifuge is introduced through the feed pipe assembly 22 and thereafter flows through passageway 20, ports 28, member 26 into bowl 24 in which the mixture is separated with the low density fraction thereof being discharged through the ports 32 and with the high density fraction thereof being discharged through the discharge opening 34 (FIG. 5). For the purposes of this invention the construction of the feed pipe assembly 22, drive pulley 18, bearings 12, shaft 14, discharge ports 32 and housing 10 may be of various well known forms such that further description thereof is not necessary to the understanding of this invention. In the preferred embodiment illustrated the bowl 24 is of a structure as shown, described and claimed in the patent application Ser. No. 720,200, filed Sept. 3, 1976 now abandoned in favor of the present copending patent application Ser. No. 905,695, filed May 15, 1978 and accordingly the disclosure of such application is incorporated herein for the purpose of describing the preferred embodiments of this invention. U.S. Pat. No. 4,059,963 more fully describes, shows and claims matter relevant to this application and accordingly the disclosure of such patent is incorporated herein for the purpose of describing the preferred embodiment of this invention.

The upper member of bowl 24 has a generally conical disc portion 36 which extends outwardly and downwardly from the portion thereof forming chamber 30. A formed ring member 38 is suitably removably and rigidly secured to the lower end of the disc portion 36 and has an inner surface of a form to provide a smooth continuation of the inner curvature of disc portion 36 and a lower surface 40, FIG. 5, in a plane extending radially of the axis X—X. The lower member of bowl 24 also has a generally conical disc portion 42 which extends outwardly and upwardly from a lowermost cup-shaped portion 43 thereof which cup-shaped portion 43 receives the distributor accelerator member 26 therein. A formed ring member 44 having an upper surface 46 extending in a plane parallel to the surface 40 is supported with reference to the disc portion 42 to permit the ring member 44 to be moved axially with reference to the ring member 38 from an uppermost position whereat surfaces 40 and 46 are engaged and a lowermost position whereat surfaces 40 and 46 form the discharge opening 34 having the maximum axial extent. Ring member 44 is the uppermost portion of a piston or movable assembly which is supported for axial movement by a suitable plurality of stationary assemblies 48 suitably rigidly supported by a radial outer portion of disc portion 42. Surfaces 40 and 46 are circumferentially continuous and in axial alignment such that when in engagement with each other a proper seal is maintained therebetween by the assemblies 54. Surfaces 40 and 46 can be of any suitable cooperable configuration to provide such seal however edges 40 and 46 are preferably parallel surfaces as described to minimize the variation in flow resistance of the material therebetween when the discharge opening 34 is formed and thereby obtain a more uniform material flow.

Assemblies 48 (FIG. 2) have a common seal adaptor or formed flange 50 which extends radially outwardly of the disc portion 42 and circumferentially therearound with the radial inner end being suitably rigidly and removably secured to an external radial outermost portion of disc portion 42. A plurality of circumferentially spaced circular cross section guide pins 52 are suitably rigidly and removably secured to an intermediate radial extent of flange 50 and extend downwardly therefrom with the centers of the guide pins 52 being on a circle coaxial with the axis X—X. Each guide pin 52 has an elongated intermediate cylinder portion 71 which portions 71 are coaxially slidably received in elongated bores in respective axially aligned bushings 72. Each bushing 72 has an upper externally threaded portion which is threadedly received within the threaded bore of an adaptor 73 each of which adaptors 73 is suitably rigidly and removably supported within aligned bores of a circumferentially continuous radially inwardly extending flange portion 74 of the movable assembly 54. Suitable elongated springs 75, having spaced convolutions to permit the herein described movement of movable assembly 54, encompass the upper portions of the guide pins 52, respectively, and extend axially between the lower radial extending surface 76 of the flange 50 and the uppermost annular surfaces of the bushings 72 aligned therewith respectively.

The structural portions of the movable assemblies 54 are circumferentially continuous with the outer end of the flange portion 74 being suitably rigidly and removably secured to the lower end of a radial outermost axially extending sidewall portion 56. Ring member 44 is suitably rigidly and removably secured to the upper end of sidewall portion 56. A circumferentially continuous upper flange portion 58 extends radially inwardly of the sidewall portion 56 and overlies a radial outer extent of the circumferentially continuous flange 50. Flange 50 has an upstanding circumferentially continuous flange portion 59 radially inwardly of the radial inner end of flange portion 58 whereby a circumferentially continuous chamber 60 is formed by the axially extending radial outer surface of flange portion 59, the radially extending lower surface of flange portion 68, the radial inner surface of the sidewall portion 56 extending axially downward from the flange portion 58 and the radially extending upper surface of the flange 50 radially outward of the flange portion 59. The radial inner end of flange portion 58 is radially spaced from flange portion 59 and the radial outer end of flange 50 is radially spaced from the sidewall portion 56 to provide respective upper and lower vent passageways 63*a* and 63*b*. The upper vent passageway 63*a* communicates with the exterior of the wall portion 56 by means of a suitable plurality of circumferentially spaced passageways 57, one of which is shown in phantom which passageways extend from passageway 63*a* radially through the upper flange portion 58. See also Ser. No. 905,695 for a full showing of such passageway although not shown a check valve is located in the radially outer extent of each passageway 57 to prevent the entry of dirt interiorly of wall portion 56.

A control member 62 consisting of a selectively pressurizable annular flexible tube is closely received within chamber 60 to effect controlled movement of the movable assembly 54. Control member 62 is pressurizable from a suitable external pressure course through suitable supply lines such as by a suitable number of circumferentially spaced tubular supply lines 67 in communication with the interior of control member 62. Supply lines 67 extend radially inwardly and downwardly of chamber 60 through suitable openings in flange 50 and thence along the outer surface of the lower member of bowl 24 into registry with the respective open ends of circumferentially spaced passageways 64. Passageways 64 extend radially inwardly from the exterior of shaft 14 to a central passageway 65 extending coaxially downwardly within shaft 14 with the lowermost end of passageway 65 being in registry with a suitable air flow control 66 having a suitable controllable supply line 68 connected thereto. Although any suitable fluid can be utilized to pressurize the control member 62, pressurized air is preferred due to its availability, the known controls for controlling air flow, and the minimal inertial effect thereof; accordingly, air is described herein as the operating fluid for the control member 62. Control 66 is of any suitable type to permit the flow of air to be controlled as described herein and suitable known fittings, not shown are utilized between the described portions of the air supply system.

Inasmuch as ring member 44 moves axially with respect to the lower disc portion 42, a suitable flexible circumferentially continuous seal 70 is provided therebetween. As shown, seal 70 has a vertical extent suitably captively retained between the outer circumferential edge of lower disc portion 42 and an axial radial innermost extent of flange portion 59 of flange 50 and a horizontal extent suitably captively received between a lower radially extending surface of the ring member 44 radially inward of the side portion 56 and the upper radially extending surface of flange portion 58 radially inward of the side portion 56. With such structure the knee or intermediate portion of the seal 70 is flexed or stretched when the edges 40 and 46 are in engagement and relaxed when the edges 40 and 46 are separated to generally maintain the curvature of the inner surface of the lower portion of the bowl 24 in both the flexed and relaxed conditions.

Control member 62 is of any suitable configuration cooperable with the surfaces of chamber 60 to selectively axially position the movable assembly 54 relative to the upper portion of the bowl 24 and, as shown, is a hollow rectangular member through the extent of axial movement of the movable assembly 54. Control member 62 is pressurized, as desired, from a controllable source of pressurized air, not shown, such that air at the desired pressure flows through supply line 68, control 66, passageways 65 and 64, lines 67 to the interior of control member 62. Thus, in operating the centrifuge as set forth in Ser. No. 905,695 the control member 62 is pressurized to force the surfaces 46 and 40 into engagement, FIG. 2, and, as desired, the pressurized air is selectively reduced via operation of the control 66 to permit the bias of springs 75 to move the movable assembly 54 axially downwardly to provide the desired axial extent of opening 34. The pressure of the air in control member 62 is reduced as desired by closing the supply line 68 and exhausting the pressurized air through lines 67, passageways 64 and 65, control 66 to atmosphere or, if desired, to a receiver by means of a flow line, not shown, connected to control 66. Since the bias of springs 75 moves the movable assembly 54 axially downwardly vent lines **63*a* and 63*b* ensure that chamber 60 is vented to the atmosphere through passageways 57 to ensure there is no back pressure on the seal 70 on the control member 62 during any axial movement of movable assembly 54. It will be realized that atmospheric pressure exists in the area surrounding springs 75 notwithstanding the circumferential continuity of the structural members 44, 56, 58 and 74 of the movable assembly 54**.

Since the control member 62 axially overlies the springs 75 and each is effective between the flange 50 and the movable assembly 54 as described, the control member 62 and spring 75 comprise a variable force system for actuating the movable assembly 54. Thus, springs 75 provide a constant bias urging the movable assembly 54 downward such that gap 34 is formed and control member 62 is selectively actuatable to overcome the bias of the springs 75 to any selected degree depending upon the air pressure therein; whereby the gap 34 is of any axial extent as desired within the limit of the axial travel of the movable assembly 54, or, if desired gap 34 can be eliminated by forcing surfaces 46–40 into engagement. Since springs 75 and control member 62 produce oppositely directed axial forces on the movable assembly 54; the bias force of the springs 75, the areas upon which the control member 62 is effective to produce movement of the movable assembly 54, and the air supply pressure are selected to provide such described movement of the movable assembly 54. By providing the described bias of springs 75 the position of surface 46 relative to surface 40 can be calibrated with reference to the air pressure within control member 62; i.e. for a given air pressure in control member 62 a known width of discharge opening 34 is obtained. Springs 75 can, if desired, be eliminated however the same positive control of the width of gap 34 is not necessarily obtained since the effect of the bias force of springs 75 is also eliminated. Also, by redesign, the directions of the described forces of the movable assembly 54 can be reversed by relocating the springs 75 and the control member 62.

With the movable assembly 54 described the bias of each spring 75 is selectively adjustable by axially positioning the lower end of a spring 75 relative to the movable assembly 54 by axially positioning bushing 72 with respect to the threaded bore of the adaptor 73. Also a suitable lock nut 77 is provided which threadedly engages the external threads of the bushing 72 and the lower radial surface of adaptor 73 whereby a selected relative axial position of bushing 72 and adaptor 73 can be maintained. A suitably formed cap member 78 is secured to the lower end of bushing 72 to prevent dirt and the like from entering the movable assembly 54 and intefering with the operation thereof. Further a suitable flexible member 79 is suitably secured to the flange portion 74 and the lower portion of bowl 24 which extends circumferentially therearound to prevent dirt from entering the movable assembly 54 from the underside of the centrifuge. If desired, and preferably, the lower end of each guide pin 52 has a lowermost axially extending threaded stem 81 which carries an axially adjustable nut 82 having an integral or separate washer or stop 83 extending radially outwardly from the upper surface of the nut 82. Stops 83 are located in the path of movement of the bushings 72, respectively, such that upon movement of the movable assembly 54 downwardly under the bias of springs 75 the lowermost position of the bushings 72 engage the stops 83 at a known preselected axial location to provide a discharge opening 34 of a known axial length. A fixed maximum opening 34 is particularly desired in instances where the material discharged by the centrifuge is normally of the same composition. The heretofore described structure for controlling the material discharge has many substantial advantages. As known, during operation of a centrifuge the material within the centrifuge exerts a pressure on the inner surface area of ring member 44 tending to shift the central axis of the ring member 44. By providing a circumferentially continuous ring member 44 with the central axis of ring member 44 concentric with axis X—X such forces tend to be balanced to maintain such concentricity. Since the control member 63 is inflated from an external pressure source the size of the discharge opening 34 is controllable independently of the speed and/or density of the material within the bowl 24.

Another advantage of the structure described is that the stationary assembly 48 and the movable assembly 54 can be removed from the lower portion of the bowl 24 and assembly 54 can be removed from assembly 48 to facilitate the replacement of worn components. Further, by the described adjustment of the bias of springs 75 the ring member 44 can be properly located with respect to the ring member 38 notwithstanding the minor variations in the structure of assemblies 48 and 54 an occur in manufacturing. Also, the bias of springs 75 can be adjusted externally of the centrifuge. A particular advantage is that the surfaces upon which forces are produced to move the assembly 54 are simple planar contact areas which do not require precision machinery. Also, by uniform circumferential spacing of pins 52 and a long engagement area between cylinder portions 71 and the bores of bushings 72 concentricity is maintained between the movable assembly and the axis X—X. The large bearing area of portion 71 and bushings 72 are readily machined to the tolerances required to maintain such concentricity inasmuch as they are simple cylindrical surfaces. The control member 62 eliminates the necessity of any seals between assemblies 48 and 54 and since control member 62 is encompassed by the surfaces of chamber 60, as the areas of vent passages **63*a* and 63*b* are minimal, the control member 62** need only be of a strength to prevent rupture or wear of a captive member as compared to the rupture or wear strength required of an unsupported member.

In order to control the slurry input flow in accordance with the principles of this invention the distributor accelerator 26 is of a form to accelerate the incoming slurry to the desired velocity for entering the bowl 24, to discharge the accelerated slurry at a desired selected direction relative to the bowl 24, and to provide a back pressure on the incoming slurry independently of the pressure existing within the bowl 24. The distributor accelerator 26 is also preferably a replaceable member. In accomplishing such purposes the distributor accelerator 26 can be of various structures with the structure of FIG. 3 being presently preferred. In such embodiment, the distributor accelerator 26 is a unitary formed structure of generally rectangular cross section which extends circumferentially around the shaft 14 outwardly adjacent the discharge ports 28 and has a formed flow passageway extending radially therethrough. The lowermost surface of the distributor accelerator 26 extends radially outwardly and the radial outermost surface thereof extends axially upwardly from the lowermost surface to provide suitable outer surfaces which are closely received in the lower cup-shaped portion 43. Distributor accelerator 26 is suitably secured to the portion 43 in any suitable manner such as by removable threaded fasteners 5 extending radially through the cup-shaped portion 43 into engagement with the outer axially extending surface of distributor accelerator 26.

The flow passageway through the distributor accelerator 26 has four sequential portions with the lowermost portion being a slurry inlet 7, in fluid communication with the discharge ends of ports 28, an accelerating portion having a passageway extending axially therethrough from the inlet 7 with circumferentially spaced vanes 9 extending radially thereacross to accelerate the slurry, a nozzle portion having a nozzle passageway 11 extending axially upwardly and radially inwardly from the upper edges of the vanes 9 and a discharge portion having a through passageway 13 therein to direct the slurry into the bowl 24. Inlet 7 is an open sided and upwardly open circumferentially continuous volume which receives the slurry from the ports 28 and provide the required slurry flow to the vanes 9. Inlet 7 is of a volume below the vanes 9 to provide a flow of slurry to the passageway in which the vanes 9 are located with a minimum of pressure head loss. The accelerating portion comprises a passageway having a suitable number of radially extending vanes 9 therein which are of an axial length to provide the desired acceleration of the slurry at a rate to provide the proper supply of the slurry to the bowl 24 and are preferably of a suitable impeller type as is known for accelerating fluids. The nozzle passageway 11 is circumferentially continuous and is of a convergent type having its inlet immediately adjacent and in fluid flow communication with the passageway having vanes 9 therein. The flow axis of the nozzle passageway 11 extends at a convergent angle with respect to the axis X—X. In order to provide such radial inward inclination of the nozzle passageway 11 the radially inner surface of passageway 11 is formed on a ring portion 15 which encompasses the shaft 14 and extends axially downwardly from the lower end of the discharge passageway 13 to the lower end of the accelerator portion with the radially inner ends of vanes 9 terminating at the radially outermost surface of the ring portion 15 below the passageway 11. The lower edges of the vanes 9 and the ring portion 15 are located in the axial upper plane of the slurry inlet 7. The nozzle passageway 11 is of a converging configuration such that the pressure of the slurry at the inlet and the pressure of the slurry at the throat is maintained at a ratio with reference to the parameters affecting fluid flow through the nozzle passageway, to ensure that the pressure required to supply slurry to the slurry inlet 7 is independent of the pressure existing in the bowl 24, i.e. the characteristics of the distributor accelerator 26 establishes the pump pressure required to pump the slurry to the slurry inlet 7. In addition, the nozzle passageway 11 is inclined radially inwardly towards the axis X—X at an angle such that the slurry has the desired rotational velocity upon entering the discharge passageway 13. It is to be realized that the rotational velocity of the slurry within the slurry inlet 7 is dependent upon the desired rotation of the bowl 24 since the distributor accelerator 26 is integral with the bowl 24. In view of the slippage occurring within the distributor accelerator 26 the angular velocity of the slurry is subject to being reduced. Accordingly, the passageway 11, by being inclined towards the shaft 14, increases the angular velocity of the slurry as it traverses passageway 11 to provide the desired angular velocity of the slurry at the entrance of the discharge passageway 13 and at the entrance of the bowl 24.

Figure 3:
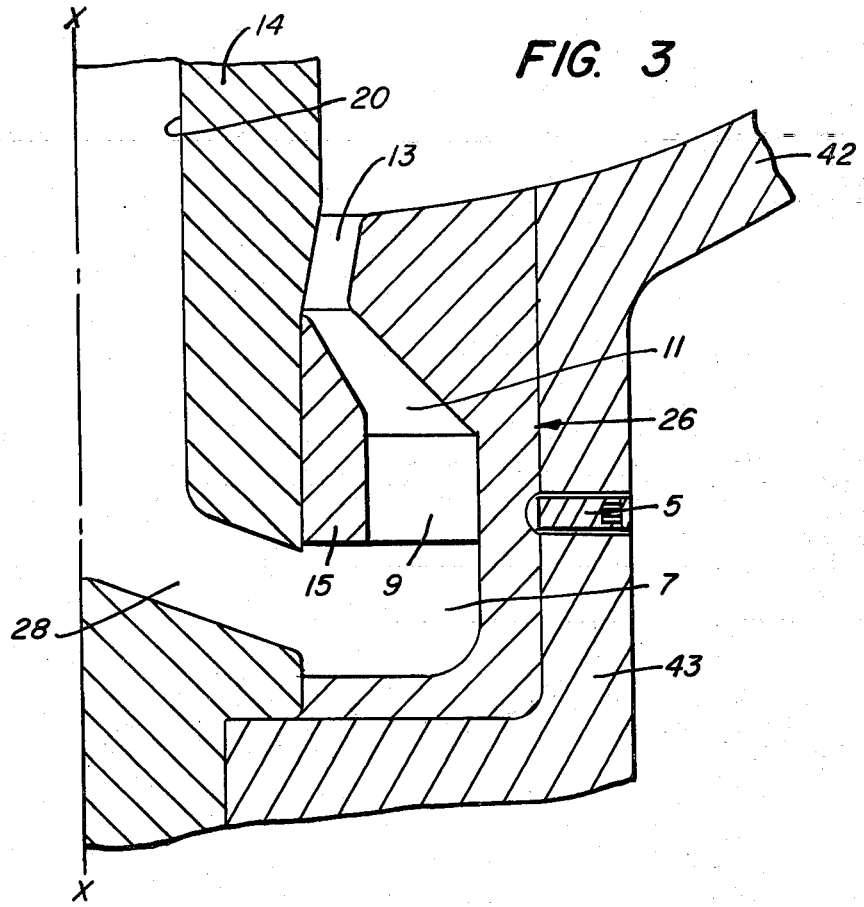
FIG. 3 is an enlarged cross sectional view of the distributor accelerator structure as shown in FIG. 1.

The discharge passageway 13 is circumferentially continuous and formed by the outer surface of the shaft 14 and a surface on the upper portion of the distributor accelerator 26 and provides a through passageway to introduce the slurry into the bowl 24 at a velocity such that there is a minimum of turbulence between the slurry entering the bowl 24 and the material already within the bowl 24. Accordingly, the slurry is discharged from the discharge passageway 13 with an angular velocity as close as feasible to the angular velocity of the material within the bowl 24 and with an axial velocity as close as feasible to the axial velocity of the material in the bowl 24. For such purposes, the flow axis of discharge passageway 13 of FIG. 3 is a parallel sided passageway extending axially upwardly and slightly radially outwardly to discharge at the radial innermost portion of the bowl 24. Since there are certain changes in the pressure and the angular velocity of the slurry within the discharge passageway due to such inclination the design of the nozzle passageway 11 is selected with reference to such changes. Distributor accelerator 26 has an upper surface which is a continuation of the curvature of the inner surface of the lower disc portion 42 so that the desired separation as set forth in Ser. No. 720,200 is obtained. In selecting the desired discharge velocity from the discharge passageway 13 the portion of the shaft 14 forming one side of passageway is axially downwardly tapered through the axial length of the discharge passageway 13. In the embodiment of FIG. 3 the various surfaces of the distributor accelerator 26 which are inclined with respect to the axis X—X have apexes which are coincident with the axis X—X. If desired the outer surface of the passageway in which the vanes 9 are located may be provided with an axial taper.

Figure 4:
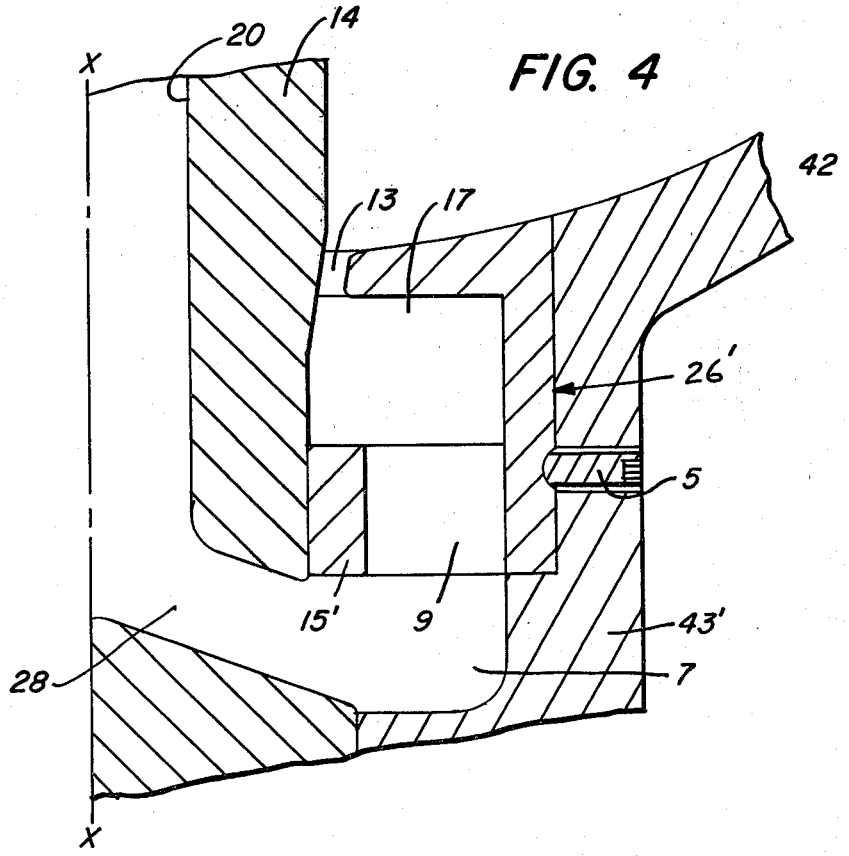
FIG. 4 is a view similar to FIG. 3 of another embodiment of a distributor-accelerator constructed in accordance with the principles of this invention.

The distributor-accelerator shown in FIG. 3 and 4 are replaceable by providing access through the housing 16, which access is not shown to permit the lower disc 22 to be removed from the shaft 14 and thereafter by releasing fasteners 5, inserting a new distributor-accelerator.

Shaft 14 has one or more ports 28 to provide a continuous supply of slurry to the inlet 7 to continuously maintain the inlet 7 full of slurry. Preferably a plurality of ports 28 are provided to supply slurry to circumferentially spaced portions of the inlet 7. As more fully set forth in Ser. No. 720,200 the slurry is separated within the bowl 24 with a resultant dischargeable product constituent, that is, the higher density portion of the separated slurry being centrifugally moved to the outer portion of the bowl 24. The dischargeable product portion moves relative to the bowl 24, however, such movement towards the discharge opening of the bowl 24 with the dischargeable portion having, as a general proposition a rotational velocity substantially the same as or slightly less than the rotational velocity of the bowl 24 and little axial velocity within bowl 24. The effluent constituent, that is, the lower density portion of the separated slurry, has a high water content relative to the product portion and is discharged from the bowl 24 through ports 32. Thus, the slurry in the separation zone of the bowl 24 must have an axial velocity to maintain the discharge and a rotational velocity to maintain the rate of depositing of material in the product portion. Inasmuch as the slurry is separated into the product constituent and the effluent constituent within the separating zone the axial and rotational velocities of the slurry in the separation zone are not, as a general proposition, equal to the axial and rotational velocities of the constituents. It is to be recognized that there are many factors which effect the velocities of the constituents as are known in the art. In accordance with the present invention for known operating parameters the slurry is introduced into the separating zone with the rotational velocity being as close as feasible to the rotational velocity of the product constituent and with the axial velocity being as close as feasible to the axial velocity required to maintain the desired discharge rate of the effluent. By so introducing the slurry with such velocities an improved separation of the slurry is obtained in that there is a minimum of turbulence created within the separating zone between the incoming slurry and the deposited product constituent so that the inner surface of the product constituent is not eroded by the incoming slurry to cause the product constituent to be reentrained into the separating zone.

With the distributor-accelerator 26 being as described and of the form as shown, the vanes 9 rotate at the same angular velocity as the bowl 24 inasmuch as vanes 9 are integral therewith. Accordingly, vanes 9 receive the slurry from the inlet 7 and accelerate the slurry such that the slurry has a given rotational velocity at the discharge end of the vanes 9 which is not necessarily the angular velocity desired for introducing the slurry into the separation zone of the bowl 24. Since passageway 11 converges towards the axis X—X the rotational velocity of the slurry increases within passageway 11. The resultant rotational velocity of the slurry is at a value with relation to any decrease in rotational velocity within passageway 13 such that the slurry enters separating zone with substantially the same rotational velocity as the deposited material within the bowl 24. Thus vanes 9 increase the hydrostatic pressure within the slurry to a value necessary to provide the required volume flow of slurry to the separating zone through the passageways 11 and 13 at substantially the rotational velocity of the bowl 24. The discharge passageway 13 has an axial extent such that the axial velocity at discharge is at the value required to obtain the desired rate of flow through the discharge ports 28. The axial extent of passageway 13 is of a configuration to compensate for any gain or loss of rotational velocity of the slurry in passageway 11. The width and length of passageway 13 are also selected to obtain the desired axial and rotational velocity of the slurry as it is discharged into the separation zone.

In designing a distributor-accelerator 26 the axial and rotational velocities of the constituents within the bowl 24 determine the value that is desired for the axial and rotational velocities of the slurry for its introduction into the separation zone. Thus, the distributor-accelerator 26 is designed with reference to the operating parameters known or described; however, once the configuration of the distributor-accelerator 26 is established the pressure of the slurry as it is introduced into the separating zone is determined by the distributor-accelerator 26 independently of the actual value of the axial and rotational velocities of the constituents.

FIG. 4 illustrates another distributor-accelerator 26' construed in accordance with the principles of this invention which is similar to the distributor-accelerator 26 of FIG. 3 except that the nozzle passageway 11 of FIG. 3 has been eliminated and an intermediate chamber provided between the accelerator vanes 9 and the discharge passageway 13'. With such construction the nozzle portion is replaced by a chamber 17 into which the accelerated slurry is discharged by the vanes 9. A ring portion 15' is provided similar to ring portion 15 except that the portion thereof above the vanes 9 is eliminated. The slurry inlet 7 is of the same configuration as described; however, the lower and outer walls thereof are formed by the cup-shaped portion 43' which is similar to cup-shaped portion 43 previously described except for the structural changes required to form inlet 7. The chamber 17 provides for a volume of slurry axially above the vanes 9 such that the effect of the turbulence of the vanes 9 on the material in the bowl is reduced. Chamber 17 does have a more turbulent slurry flow therein than nozzle portion of FIG. 3; however, such turbulence can be accepted as it is isolated from the bowl except for passageway 13'. Although the flow of slurry through distributor-accelerator 26' differs from the flow of slurry through the distributor-accelerator 26 each structure provides the desired axial and rotational velocities to the slurry as described.

The embodiment heretofore described was that preferred at the time this application was originally filed; however, other preferred embodiments are also contemplated at the present time. FIGS. 6 to 12 illustrate additional embodiments of this invention in which like parts of the heretofore described structure are identified by the same reference numeral.

Figure 6:
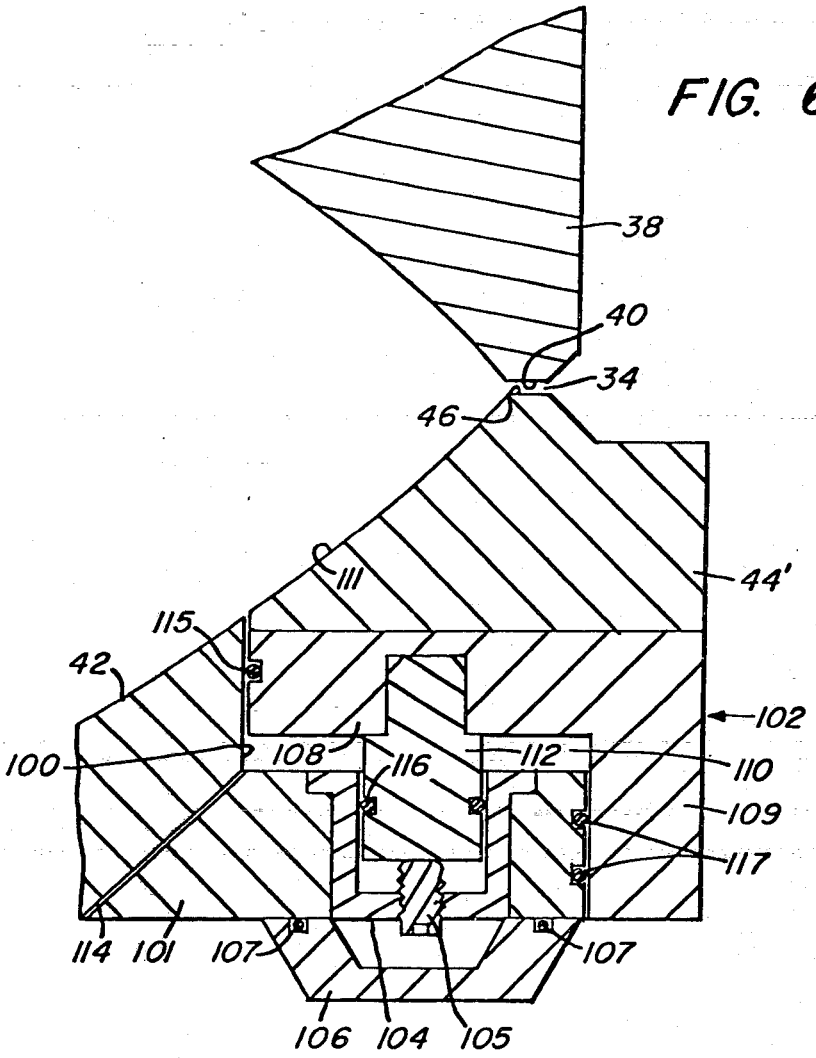
FIGS. 6 to 8 are cross sectional views of alternate material discharge control mechanisms wherein a portion of the bowl of the centrifuge is axially moveable.

FIG. 6 illustrates an alternate embodiment for providing a closed or fixed axial length discharge opening 34 in which a simplified form of guided piston is used in place of the pressurizable control member 62 and the stationary assemblies 48. Bowl member 24 is of a structure as previously described except that the outer periphery of the conical disk portion 42 is modified to guideably support a movable piston member 102 having a ring member 44' similar to the ring member 44. As shown, the outer periphery of the disk portion 42 is provided with a vertically extending circumferentially continuous surface 100 radially inwardly from the opening 34 which extends from the inner surface of disk portion 42 to a circumferentially continuous flange portion 101 extending radially outwardly therefrom. Flange portion 101 supports the piston member 102 for controlled axial movement and for such purpose is provided with a suitable plurality of circumferentially spaced through bores each of which has an upwardly open cup-shaped guide member 104 suitably captively secured therein. An adjusting screw 105 is suitably carried by the axial lowermost bight portion of each guide member 104 so that the uppermost end of each screw 105 is selectively axially positionable within the associated guide member 104. Each screw 105 is axially positionable externally of the guide member 104; and, a suitable cover, shown as a dished shaped cover 106, is suitably removably secured to the underside of flange portion 101 to protect the circumferentially spaced screws 105. Suitable circumferentially continuous and extending radially spaced gaskets 107 are provided to provide a seal between the cover 106 and the atmosphere.

Piston member 102 comprises a formed circumferentially continuous ring member having a radially extending portion 108 which is axially upwardly spaced from and overlies the flange portion 101 and an axially extending outer portion 109 which circumferentially encompasses the radially outer dually extending end of the flange portion 101 to form a variable volume chamber 110 between the piston member 102 and the outer end of disk portion 42. Ring member 44' is suitably rigidly secured (not shown) to the upper surface of portion 108 to provide a replaceable member; however, if desired ring member 44' may be made integral with the portions 108 and 109 of the piston member 102. Ring member 44' is provided with the surface 46 which is cooperable with the surface 40 as previously described. The interior surface 111 of ring member 44' is of a configuration or contour to provide a continuation of the curvature of the inner surface of the disk member 42 as described in copending application Ser. No. 905,695. Piston member 102 is also provided with circumferentially spaced guide pins 112 which are suitably rigidly secured to portion 108 to extend downwardly therefrom with the lower portion of pins 112 being captively and closely slideably received in the central opening of guide members 104, respectively. In order to prevent unbalanced loading on piston member 102 each cooperable pin 112 and guide member 104 has a common central axis parallel to the axis X—X with each such central axis being located in a circle having a center at the axix X—X. Pins 112 and the central openings of guide members 104 are of any suitable cross section to guide the piston member 102 throughout its movement. In operation the piston member 102 is actuated by selectively supplying or releasing pressurized air in a manner as previously described with reference to control member 62; accordingly, suitable fluid passageways 114 (only the upper portion of one of which is shown) are provided in disc member 42 communicating with chamber 110 for so supplying or releasing a control fluid such as air as is hereinafter described.

As shown, piston member 102 is in its lowermost axial position with the lowermost end of the guide pins 112 being in engagement with the uppermost ends of screws 105 whereby the maximum desired opening 34 is obtained. In such lowermost position of piston member 102 the radially innermost end of surface 111 is in contoured alignment with the interior surface of disc portion 42 and with chamber 110 being at its smallest volume. When it is desired to close the opening 34 air is suitably admitted to chamber 110 through passageways 114 at a pressure to move the piston member 102 axially upwardly so that surfaces 46 and 40 are engaged. During such upward movement the inner end of ring member 44' is axially upwardly offset from the interior surface of disc portion 42; however, since no material is being discharged such offset does not adversely effect the operation of the centrifuge. The axial lengths of portions 108 and 109 and the guide pins 112 are selected with reference to the maximum opening 34 to guide the piston member 102 throughout the entire range of axial movement. Further, in order to minimize air leakage a suitable circular seal 115 is suitably carried on the inner radial periphery of portion 108 which seal 115 engages the surface 100, a suitable circular seal 116 is carried on the outer periphery of each guide pin 112 which seal 116 engages the inner periphery of the associated guide members 104, and a pair of axially spaced circular seals 117 are carried on the outer periphery of flange portion 101 which seals 117 engage the inner periphery of outer portion 109. Seals 115, 116 and 117 are located to maintain sealing engagement with the surface cooperable therewith throughout the axial movement of the piston member 102. Since the engagement of screws 105 with the axial lowermost ends of guide pins 112 determines the maximum axial extent of discharge opening 34, ring cover 106 is removable to permit access to screws 105 to permit adjustment of the maximum opening 34 and to insure that opening 34 is of uniform axial length throughout its circumferential extent.

When it is desired to close discharge opening 34 pressurized air is controlably admitted through air lines 114 to chamber 110 which is effective between the upper surface of flange portion 101 and the undersurface of portion 108 to move the piston member 102 axially upwardly until surface 46 engages surface 40. Thereafter, as desired, the pressurized air may be controlably vented from chamber 110 through air lines 114 to permit reestablishing the discharge opening 34. Although two guide pins 112 will provide the desired guiding of the piston member 102, six to eight uniformly circumferentially spaced guide pins 112 are preferred. The embodiment of FIG. 6 provides a simplified structure wherein the chamber 110 is formed by utilizing well known circular seals 115, 116 and 117, the piston member 102 is carried by the flange portion 101 so that there are no depending operating components such as assemblies 48 and the piston member 102 cooperates directly with the disc portion 42 throughout its axial travel without requiring any intermediate deformable seal such as the seal 70 previously described.

Figure 7:
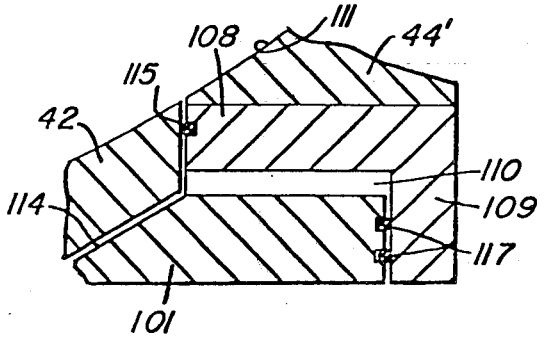
Figure 8:
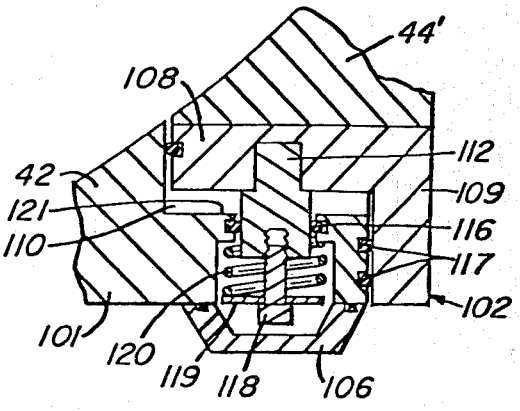

FIG. 7 illustrates a section of the flange 101 and the piston member 102 at a location spaced circumferentially from the peripheral cross section shown in FIG. 6; however, the section of FIG. 7 also illustrates another embodiment in which the previously described guide pins 112, guide members 104 and set screws 105 have been eliminated to provide a simplified structure. In such other embodiment of FIG. 7 the piston member 102 operates in the same manner as the embodiment of FIG. 6; however, the piston member 102 is guided through its axial movement solely by the surface 100 and the outer peripheral surface of flange portion 101. If desired a spring bias can be applied to piston member 102 to bias the piston member 102 to the open position as shown in FIG. 8. FIG. 8 illustrates a peripheral cross section of the flange portion 101 and the piston member 102 spaced circumferentially from the section shown in FIG. 6; however, FIG. 8 also illustrates another embodiment of the invention. In such embodiment each guide pin 112 receives an axially adjustable set screw 118 which has a washer 119 and an open helical coil spring 120 intermediate the lowermost head of screw 118 and a formed shoulder 121 on flange portion 101 provided by circumferentially spaced stepped counterbores extending axially upwardly within flange portion 101. Each spring 120 extends axially between a washer 119 and the undersurface of shoulder 121 such that upon axially upward movement of piston member 102, each spring 120 is compressed to provide a bias upon piston member 102 to bias piston member 102 axially downward. Axial adjustment of screws 118 will establish such bias force on the piston member 102. Also, seal 116 is preferably reversed in this embodiment; i.e. carried on the periphery of shoulder 121. With this structure the piston member 102 is maintained by an applied force with respect to flange portion 101 at the full opening of opening 34 and adjustability of the force required to close opening 34 is obtained.

When the structure of FIG. 8 is combined with the structure of FIG. 6, a desired number of circumferentially spaced guide pins 112, such as every other one, and the adjacent portions of the flange portion 101 are modified to provide the structure shown in FIG. 8. With such modification the bias as described with reference to FIG. 8 and the adjustable discharge gap 34 as described with reference to FIG. 6 are both obtained in a single structure.

Figure 9:
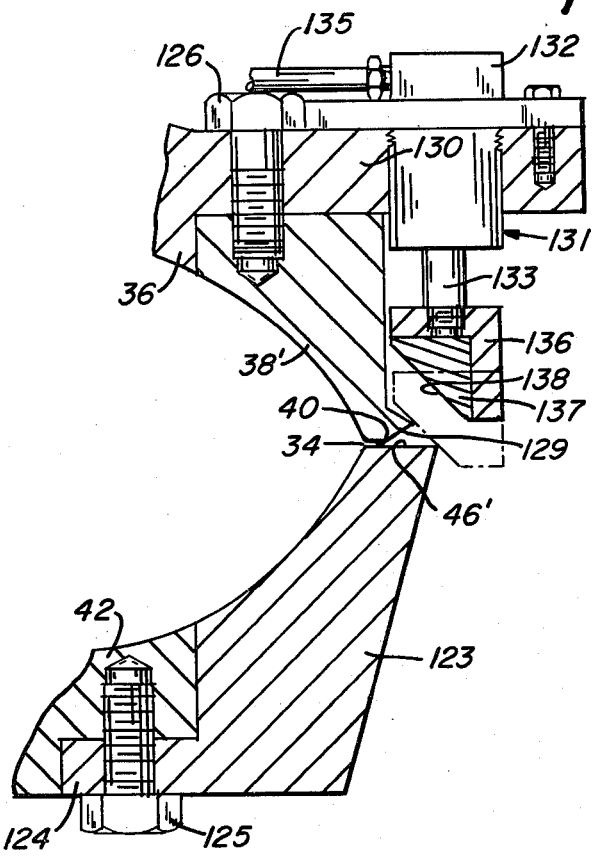
FIGS. 9 to 12 are cross sectional views of alternate material discharge control mechanisms wherein a member external of the bowl of the centrifuge is axially moveable.

FIGS. 9, 10, 11 and 12 show additional embodiments for controlling the discharge of material from the discharge opening 34 in which the movable piston members which carry one member forming the discharge opening as previously described have been replaced by external control members. In the embodiment of FIG. 9, the radially outer peripheral portion of the lower portion of the bowl 24 is a formed ring member 123 having an inner surface of a configuration or contour to obtain the desired flow of material as is more fully described in copending application Ser. No. 905,695. The lowermost portion of member 123 has a radially inwardly extending flange portion 124 which underlies a portion of the outer periphery of the disc portion 42 to permit ring member 123 to be suitable rigidly secured to the disc portion 42 such as by circumferential spaced bolts 125, only one of which is shown. Member 123 has an axially uppermost radially outwardly extending surface 46' which is for the same purpose as surface 46 previously described but which surface 46' extends radially beyond a radially outer peripheral ring member 38 previously described and is provided with the radially outwardly extending circumferential surface 40 to form the upper surface of the discharge opening 34. Ring member 38' is suitably rigidly carried by disc portion 36, as shown by bolts 125, with an inner surface of a configuration or contour to obtain the desired material flow as described in copending application Ser. No. 905,695. Although the mating surfaces between disc portion 35 and ring member 38' and the mating surfaces between disc portion 42 and ring member 123 may be of any suitable configuration, as shown, such mating surfaces are located with respect to each other to permit ring member 123 to be disassembled from disc portion 42 and thereafter permit ring member 38' to be disassembled from disc portion 35 and lowered downwardly over the outer periphery of disc portion 42. Thus, ring members 123 and 38' are readily replaceable. Ring member 38' is also provided with an integral circumferentially continuous radially outwardly extending projection 129 having a radially inwardly and downwardly inclined lower surface with the lowermost end thereof terminating radially intermediate the radial extent of surface 46'. Thus, as before described the spacing of surfaces 40 and 46' from the discharge opening 34; however, in this embodiment the axially lowermost surface of projection 121 and surface 46' form an outwardly and axially divergent extension of opening 34.

The disc portion 36 has an integral radially outwardly circumferentially continuous flange portion 130 through which the bolts 126 extend and to which a suitable number of actuating cylinder assemblies 131 are suitably secured. Cylinder assemblies 131 are preferably air or hydraulically operable and may be of any suitable type such as double acting or single acting with a spring bias return as is known. Preferably at least three assemblies 131 are provided spaced at 120 degrees from each other with respect to the circumference of flange portion 130 to provide the desired closing action; however, if desired two or more than three assemblies 131 can be equally spaced about the circumference of the device. Each cylinder assembly 131 has an elongated housing 132 and an elongated extensible and retractable rod 133 as is well known. Each housing 132 extends through a through bore in flange portion 130 and is suitable rigidly and removably secured to flange portion 130 with the upper axial end thereof being accessible to suitably attach a suitably operating fluid supply line 135 thereto. Operating fluid, hereinafter described as air, is controllably supplied to each cylinder assembly 131 to extend and retract the rods 133 in unison as is known. The axially lowermost end portion of each rod 133 is removably and rigidly secured to a ring seal housing 136 which circumferentially encompasses the outer peripheral portion of ring member 38'. Housing 136 if of a form to continually circumferentially support a ring-shaped seal 137 which seal 137 is of any suitable material to permit a lsight deformation thereof when closing opening 34. Cylinder assemblies 131 are located with respect to flange portion 130 to close opening 34 upon extension of the rods 133 with seal 137 engaging the radially outermost end of projection 129 and ring member 123 at the outer end of surface 46' and with seal 137 and housing 136 being spaced axially upward of the opening 34 upon retraction of rods 133. In operation seal 137 engages the outer end of the projection 129 and the ring member 123 at the outer end of surface 46' throughout the circumference thereof as shown in phantom outline. Such engagement can be simultaneous or substantially simultaneous as desired. Since seal 137 is deformable the projection 129 and the end of surface 46' enter the area occupied by the seal 173 in its undeformed state to provide a proper continuous seal. Obviously, depending on the form of seal 137 the projection 129 and the end of surface 46' various forms of projection 129 and the ring member 123 at the end of surface 46' can be used to obtain the described sealing engagement with seal 137. In the presently preferred embodiment of FIG. 9 the seal 137 is of a generally triangular shape having an inner surface 138 inclined axially downwardly and radially outwardly with respect to the central axis X—X and with such structure the housing 136 is of an inverted L-shape in which the seal 137 is simultaneously supported on its upper and outer sides during deformation thereof. Obviously, housing 136 and 137 may be of various configurations to provide such support during deformation of the seal 137. Upon retraction of rods 133 the housing 136 is positioned upwardly adjacent the opening 34 so as not to interfere with the flow of material being discharged through opening 34.

Figure 10:
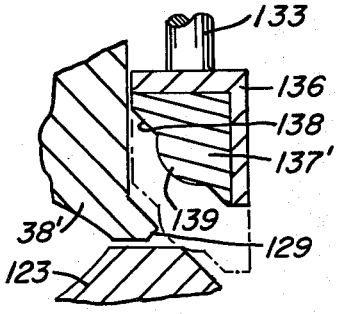
Figure 11:
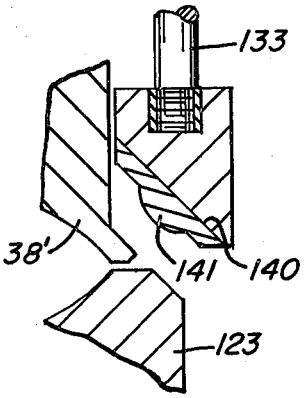

FIG. 10 illustrates an alternate form of seal 137' similar to seal 137 in which the inner surface 138 has a central integral protrusion 139 which engages the projection 129 and the ring member 123 at the end of surface 46' and is deformed thereby. FIG. 11 illustrates an alternate housing 136' which is made from a non-metallic material, such as hard rubber, and which has a suitable metallic insert secured in the upper portion of housing 136' to permit securing the housing 136' to the rods 133. Housing 136' also is provided with a lower surface 140 which is sloped radially outwardly and downwardly with respect to the axis X—X and to which is secured a ring seal 141. Seal 141 is a deformable material like seal 137 and is in the form of a strip which is secured to surface 140 and has a central protrusion, like protrusion 139, to close opening 34 as described. As shown the outer end or ring member 123 is tapered to permit the lower end of seal 141 to properly engage the ring member 123 and projection 129.

Figure 12:
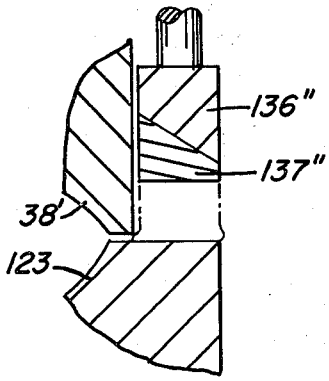

FIG. 12 illustrates another embodiment wherein a housing 136'' carries a seal 137'' having a lower cylindrical portion. With such cylinder portion of seal 137'' the projection 129 is eliminated so that the lower end of seal 137'' engages the surface 46' radially outwardly of the opening 34 and is deformed (see phantom showing) by engaging surface 46' with the lower end being deformed to enter into opening 34 and provide a proper seal. Seal 137'' has an upper surface which is supported by housing 136'' to provide the operation as described.

With the embodiments of FIGS. 9 to 12 the control of material discharge is achieved by external devices which are of well known reliability. Further such embodiments permit the inner surfaces of the disc portions 36 and 42 to be, for all practical purposes, continuous.

Various modifications to the inventions described can be made. Thus, the embodiment of FIG. 2 can be modified by placing the springs of the assembly 48 circumferentially intermediate the pins 52 rather than encompassing the pins 52. Also, although the embodiments of FIGS. 9 to 12 show one discharge gap 34 of a fixed length, gap 34 is adjustable prior to operation of the device by selectively positioning the formed portions of the bowl member axially on the central drive shaft to provide various discharge gap 34 openings within the range of the movement of the piston member 102. Also, with reference to the embodiments of FIGS. 9 to 12, the discharge gap 34 need not be circumferentially continuous and with such structures the gap closure member need not be circumferentially continuous although, at present, such circumferentially continuous closure member is certainly preferred. Further the material discharge can be through circumferentially spaced nozzles with the structures of FIGS. 9 to 12 centralized to clear the outer discharge ends of the nozzles. If desired, in order to eliminate the supply and exhaust piping required to operate a fluid operable cylinder 131 a suitable electrically operable cylinder-rod can be used. Regardless of the types of cylinder-rod control utilized the closing force of such cylinder-rod is adjusted to provide the desired distortion of the closure member.

Although preferred embodiments of this invention have been described in accordance with the Patent Statutes those skilled in the art to which this invention relates will realize that various modifications can be made to the structures described without departing from the spirit and scope of the invention. Accordingly, the claims hereto are to be construed in accordance with the knowledge of one skilled in the art to which the invention relates.

I claim:

1. A centrifuge comprising an elongated shaft rotatable about the longitudinal central axis thereof; a bowl member having upper and lower formed portions secured to axially spaced portions of said shaft, respectively, for conjoint rotation therewith; said bowl member forming a centrifuge chamber for centrifugally separating a slurry into a product constituent in a radially, with respect to said axis, outer portion of said bowl member and an effluent constituent at a portion of said bowl member radially inward of said product constituent; said bowl member having means for discharging such constituents therefrom; said lower formed portion having a lowermost section with a formed through passageway therein having, relative to said axis, an axial extent with the axially uppermost end thereof being in open communication with the interior of said bowl member, said shaft having a bore therein for receiving a slurry and for discharging said slurry into an axially lower portion of said passageway, said passageway forming a closed pathway for flow of slurry from said bore into said centrifuge chamber, said lower portion of said passageway having, relative to said axis, a circumferentially and radially outermost extent located radially outward of the radially outermost extent of said uppermost end; and, said passageway having means to control the rotational velocity of a slurry flowing through said passageway.

2. A method of controlling the axial and rotational velocity of a slurry continuously supplied to a rotary bowl centrifuge rotatable about an axis wherein the slurry is supplied through an elongated passageway in the bowl and subsequently separated in the bowl into a product constituent located within and discharged from a radial outer portion of the bowl and an effluent constituent located radially inwardly of the product constituent and discharged therefrom comprising, initially simultaneously rotationally accelerating and increasing the hydrostatic pressure of an incoming slurry with such a passageway, immediately after such initial accelerating further increasing the rotational velocity of such a slurry with such passageway by having such slurry flow towards said axis, and immediately after such further rotational acceleration discharging such a slurry from such passageway into the interior of such a rotary bowl at a rotational velocity substantially equal to rotational velocity of such a product constituent.

3. A centrifuge comprising: an elongated upstanding shaft rotatable about the longitudinal central axis thereof and a bowl having upper and lower formed portions secured to axially spaced portions of said shaft, respectively, for conjoint rotation therewith; said bowl forming an interior chamber for centrifugally separating an incoming slurry into a product constituent in a radially, with respect to said axis, outer portion of said bowl and an effluent constituent at a portion of said bowl radially inward of said product constituent; said bowl being associated with means for discharging such constituents therefrom; said shaft having passageway means therein for receiving a slurry and for discharging said slurry to a hollow annulus comprising an axially lower portion of an upwardly extending passageway, formed in a lower section of said lower formed portion, which passageway has an uppermost end in open communication with said interior chamber, a part of said passageway above said lower portion of said passageway being provided with means to impart a rotational velocity to a slurry flowing through said passageway upon rotation of said shaft and bowl.

4. A centrifuge according to claim 3 wherein said passageway is of an annular configuration and surrounds said shaft with the uppermost end of said passageway being located radially inwardly of the radial outermost extent of said hollow annulus.

5. A centrifuge according to claim 3 wherein said last mentioned means controls the axial velocity of the slurry flowing into said chamber to maintain the rate of discharge of the product constituent of said slurry.

6. A centrifuge according to claim 3 wherein said means to impart a rotational velocity to said slurry comprises a plurality of vanes extending radially across said passageway and spaced circumferentially about the rotational axis of said shaft.

7. A centrifuge according to claim 6 wherein said vanes are for initially increasing the rotational velocity of a slurry flowing through said passageway, and wherein a portion of said passageway above said vanes is inclined towards said axis.

8. A centrifuge according to claim 7 wherein said inclined portion of the passageway above the vanes if of a configuration to increase said rotational velocity.

9. A centrifuge according to claim 3 wherein the uppermost end of the passageway is substantially contiguous with a surface of the interior chamber.

10. A centrifuge according to claim 3 wherein the uppermost end of the passageway is continuous and extends 360° about the circumference of the shaft.

* * * * *